US011538649B2

(12) United States Patent
Fischer et al.

(10) Patent No.: US 11,538,649 B2
(45) Date of Patent: Dec. 27, 2022

(54) CIRCUIT BREAKER HOUSING

(71) Applicant: ELLENBERGER & POENSGEN GMBH, Altdorf (DE)

(72) Inventors: Erich Fischer, Altdorf (DE); Hubert Harrer, Hilpoltstein (DE); Dean Latham, Tullahoma, TN (US); Klaus Loos, Winkelhaid (DE); Fabio Pafumi, Schwabach (DE); Klaus Werner, Roethenbach (DE); Juergen Zeberl, Lauterhofen (DE)

(73) Assignee: Ellenberger & Poensgen GmbH, Altdorf (DE)

( * ) Notice: Subject to any disclaimer, the term of this patent is extended or adjusted under 35 U.S.C. 154(b) by 119 days.

(21) Appl. No.: 16/971,986

(22) PCT Filed: Feb. 22, 2019

(86) PCT No.: PCT/IB2019/000180

§ 371 (c)(1),
(2) Date: Aug. 21, 2020

(87) PCT Pub. No.: WO2019/162758

PCT Pub. Date: Aug. 29, 2019

(65) Prior Publication Data

US 2020/0403328 A1 Dec. 24, 2020

(30) Foreign Application Priority Data

Feb. 23, 2018 (DE) ..... 102018202793

(51) Int. Cl.
*H01H 9/02* (2006.01)
*H01H 71/08* (2006.01)
(Continued)

(52) U.S. Cl.
CPC ..... *H01H 71/082* (2013.01); *H01H 9/02* (2013.01); *H01H 9/0264* (2013.01);
(Continued)

(58) Field of Classification Search
CPC ..... H01H 71/082; H01H 7/0207; H01H 9/02; H01H 9/0264; H01H 9/223; H01R 4/4827;
(Continued)

(56) References Cited

U.S. PATENT DOCUMENTS 5,841,616 A 11/1998 Crosier
6,840,823 B2 6/2005 Eschermann et al.
8,089,119 B2 * 1/2012 Nishihara ..... G11C 13/0009 257/E29.129
8,098,119 B2 1/2012 Birner et al.
(Continued)

FOREIGN PATENT DOCUMENTS

DE 10120677 A1 11/2002
DE 102006027140 A1 12/2007
(Continued)

*Primary Examiner* — William H. Mayo, III
(74) *Attorney, Agent, or Firm* — Laurence A. Greenberg; Werner H. Stemer; Ralph E. Locher

(57) ABSTRACT

A circuit breaker housing for holding a switching device unit and a number of connection contacts for a connection line and/or a busbar. The housing has a first housing part and a second housing part. In the joined, assembled state, the housing parts form a front side and a rear side opposite said front side and at least one connection side and end faces located opposite one another. A holding chamber for a connection module having one of the connection contacts is provided on the front side and/or on at least one of the connection sides.

9 Claims, 6 Drawing Sheets

(51) Int. Cl.

| | |
|---|---|
| ***H01H 71/02*** | (2006.01) |
| ***H01H 9/22*** | (2006.01) |
| *H01R 4/48* | (2006.01) |
| *H01R 9/24* | (2006.01) |
| *H01R 9/26* | (2006.01) |

(52) U.S. Cl.
CPC ..... *H01H 9/223* (2013.01); *H01H 71/0207* (2013.01); *H01R 4/4827* (2013.01); *H01R 9/2408* (2013.01); *H01R 9/2433* (2013.01); *H01R 9/2466* (2013.01); *H01R 9/2633* (2013.01)

(58) Field of Classification Search
CPC .. H01R 9/2408; H01R 9/2433; H01R 9/2466; H01R 9/2633
USPC ..... 200/50.31, 50.01, 50.32; 335/8–10, 335/167–176, 202
See application file for complete search history.

(56) References Cited

U.S. PATENT DOCUMENTS

| | | | | |
|---|---|---|---|---|
| 8,237,311 | B2 * | 8/2012 | Roth | H01R 9/2675 307/113 |
| 2006/0082979 | A1 | 4/2006 | Brandl et al. | |
| 2015/0279603 | A1 * | 10/2015 | Lang | H02B 13/0356 29/622 |

FOREIGN PATENT DOCUMENTS

| | | | | |
|---|---|---|---|---|
| DE | 202007018653 | U1 | 2/2009 | |
| DE | 202006021096 | U1 | 7/2012 | |
| DE | 202006021064 | U1 | 8/2012 | |
| EP | 1124286 | A1 | 8/2001 | |
| EP | 1376637 | A1 | 1/2004 | |
| EP | 1447829 | A1 | 8/2004 | |
| EP | 2871658 | A1 | 5/2015 | |
| FR | 1124286 | A1 * | 8/2001 | H01R 7/4818 |

* cited by examiner

CIRCUIT BREAKER HOUSING

TECHNICAL FIELD

The invention relates to a circuit breaker housing for holding a switching device for interrupting a circuit and a number of connection contacts for a connection line and/or a busbar. The invention further relates to a circuit breaker having such a housing.

BACKGROUND ART

An electrical switching unit or a circuit breaker, such as a mechanical, electronic or mechatronic switch, for example, usually has an infeed connection, via which a grid-side and thus current-feeding current or connection line can be connected, and a load connection, via which a current or connection line outgoing on the load side can be connected.

In the following text, an electrical installation having a plurality of electrical load circuits to which current is fed from a common main current line and which are connected to a common current feedback system is generally referred to as a switching unit arrangement or current distribution system having a plurality of switching units, circuit breakers or circuit breaker modules. In other words, an electrical circuit device that makes it possible to distribute electric current fed via a common main current line to a plurality of parallel load circuits is referred to as a current distributor, wherein fuse mechanisms are provided, which secure each load circuit individually against overload and/or short circuit.

Within the context of such an arrangement of modular switching units, circuit breakers or circuit breaker modules, these are usually provided in terms of circuitry, in particular, at those branch points at which the load circuits branch off from the main current line. The switching unit, the circuit breaker or the circuit breaker module in this case serves, where necessary, to isolate the associated load circuit from the current-feeding main current line for example manually or virtually automatically in the case of a short circuit or overload.

Such an arrangement, for example, on a support rail (DIN rail) of modular switching units is usually produced from individual circuit breaker modules and, where applicable, from one or more infeed terminals. The circuit breaker modules and the infeed terminals can in this case be individually wired by flexible conducting wires. As a result of the individual wiring, the assembly of such a current distributor is comparatively costly. The circuit system formed in the process is also comparatively confusing, which makes it difficult to make subsequent changes to a current distributor that has already been assembled and to remove an individual switching unit or circuit breaker module for the purpose of replacing it, in particular for reasons of safety or protection against contact.

In the context of a comparatively simple connection of a plurality of parallel load circuits, the infeed connection in switching units embodied as rail-mounted devices comprises a coupling connection, which can be brought into contact with a current-feeding current busbar spreading over a plurality of switching units. The signal current carrying can be effected in such an installation either separately from the switching units by means of separate circuit elements or in accordance with DE 20 2007 018 653 U1 likewise by means of busbars (signal busbars).

A circuit breaker, known from DE 20 2006 021 064 U1, for example, has a circuit breaker housing having a housing shell for holding tripping mechanics coupled to a switching lock and having a housing top. The tripping mechanics of the known circuit breaker comprise an electromagnetic tripping device and a bimetallic tripping device. As tripping conditions, the electromagnetic tripping device detects a short circuit (short-circuit current) while the bimetallic tripping device senses an overload state (overcurrent). When the respective tripping condition occurs, the corresponding tripping device causes a switching arm to unlatch and the resetting thereof to the opening position to be triggered.

In order to secure a circuit connected downstream of the circuit breaker or circuit breaker module effectively against a short circuit and/or overload damage, the circuit breaker or the circuit breaker module causes the fastest possible isolation of the electrical connection formed between a moving contact and a stationary contact when the tripping condition occurs. The fast quenching of a switching arc that is created during the switching process between the moving contact and the stationary contact, in particular in the case of a short circuit and overload, is brought about in the known circuit breaker by means of a quenching device (quenching chamber).

The circuit breaker of the type mentioned above can be produced both in single-pole and multipole embodiments. A multipole circuit breaker is in this case realized in a modular manner from in each case single-pole circuit breaker modules, which are arranged in series on the end side. For circuit breakers having a different number of poles, several instances of the single-pole circuit breaker module described above can expediently be combined to form a multipole circuit breaker arrangement by virtue of said circuit breaker modules each being put together on the end side. The circuit breaker modules that are strung together can form a mechanically coherent unit, wherein manual actuation mechanics of all of the circuit breaker modules are coupled at the same time so that the circuit breaker modules can be switched only at the same time. The tripping mechanics of all of the circuit breaker modules can be coupled at the same time so that all of the other circuit breaker modules are also tripped by tripping each of the circuit breaker modules.

For connection of an electrical conductor, the or each circuit breaker module has an infeed connection, which is electrically connected in the inside of the module to the stationary contact. The infeed connection of each circuit breaker module in this case has a coupling contact, by means of which a plurality of strung-together circuit breaker modules of a multipole circuit breaker arrangement can be connected in parallel by means of a busbar. The circuit breaker modules are supplied with power in this way in the manner of a current distributor via a common current feed line.

In the prior art circuit breaker, each circuit breaker module has two signal connections for the connection of conductors, which are electrically connected inside the module to a signal relay. In order to electrically interconnect the signal connections of different circuit breaker modules, a coupling contact is connected in each case in parallel with the signal connections, which coupling contact is arranged in a housing slot. Said housing slot spans the entire housing width so that a busbar designed as a profiled component can be inserted into the housing slot to bypass the coupling contacts of adjacent circuit breaker modules. To improve the operational safety of the circuit breaker, the or each housing slot is in this case dimensioned in such a way that the coupling contact is held in the housing in a finger-safe manner.

To connect supply, signal or load lines, that is to say those lines that lead to the load that is supplied with power and, where necessary, is to be protected, the known circuit breaker is provided with screw terminals, which are fixedly mounted in the circuit breaker housing of the circuit breaker in the course of production of said circuit breaker. Although other connection techniques, for example screwless contact terminals in the form of spring terminals, are also conceivable in principle, a connection technique already selected can typically no longer be changed or can be changed only with an undesirably high degree of outlay as early as during the production of the circuit breaker and, in particular, after completion thereof.

DISCLOSURE OF INVENTION

The invention is based on the object of specifying a suitable circuit breaker housing in order to provide a circuit breaker module that is as flexible as possible with respect to the connection technique and a corresponding circuit breaker. The circuit breaker housing is also preferably intended to be suitable for providing a single-pole or else a multipole circuit breaker. Furthermore, the circuit breaker housing is also expediently intended to be suitable for rail mounting, in particular in the manner of rail-mounted devices on a support or DIN rail. Furthermore, a circuit breaker module having such a circuit breaker housing and a circuit breaker having a number of single-pole circuit breaker modules are also intended to be specified.

The above object is achieved in accordance with the invention by the features of the independent claim(s). Advantageous refinements and developments are the subject matter of the dependent claims.

The circuit breaker housing serves to hold a switching device for interrupting a circuit and a number of connection contacts for a connection line and/or a busbar. To this end, the circuit breaker housing has a first and second housing part, wherein, in the joined or assembled state, the housing parts form a front side and a rear side located opposite said front side and end faces located opposite one another and at least one connection side. A, for example pocket-like, holding chamber is provided on the front side and/or on at least one of the connection sides, which holding chamber holds a connection module, which has one of the connection contacts.

The connection contact expediently has a contact element for electrical connection to a coupling contact held by the housing parts in the joined or assembled state. The coupling contact serves for electrical coupling or connection of the connection contact to a switch of the switching device, which switch is inside the housing. The coupling contact additionally serves for making electrical contact with a busbar, which for its part electrically couples connection modules of a plurality of circuit breaker modules. The switch can be embodied in a mechanical manner or as an electronic component. In an analogous manner, the switching device can be embodied in an electronic or, for example, thermal, thermomagnetic, thermohydraulic or (electro)magnetic manner.

The housing parts can each be embodied as housing half-shells (in a half-shell shaped manner) or one of the two housing parts can be embodied as a housing half-shell and the other housing part can be embodied as a housing top (in a top-like manner). It is also conceivable for one of the two housing parts to be embodied as a housing base (in a base-like manner) and the other of the two housing parts to be embodied as a housing lid or cover (in a lid-like or cover-like manner).

The invention proceeds in this case from the consideration that the greatest possible flexibility with respect to the connection technique exists when, on the one hand, the circuit breaker housing is configured for various connection techniques and, on the other hand, different kinds of connection in the form of various terminal types are provided in a modular manner in order to also be mounted in the circuit breaker housing only after completion of the desired circuit breaker module.

The switching device serves to interrupt a circuit and expediently has a tripping system or is embodied as such. The switching device can be embodied as a purely mechanical and/or manually actuable switch or as a combination of such a switch and an automatic tripping system. The switch and the tripping system can in this case be coupled to a switching lock, which acts on the switching contacts, that is to say, in particular, on a moving contact, in the case of manual switching (opening and closing) and in the case of (automatic) tripping.

In this case, "front side" and "rear side" and also "connection side" are intended to be understood as meaning, in particular, the narrow sides of the circuit breaker housing, which adjoin one another in a housing circumferential direction, wherein, in a circumferential manner, a first connection side adjoins the front side, the rear side adjoins said first connection side and the further connection side adjoins said rear side. The comparatively extensive end faces of the circuit breaker housing are arranged in planes, which are parallel to one another, spaced apart and spanned by the housing circumferential direction, wherein the spacing of said planes corresponds to the housing thickness in the region of the front, rear and connection side(s).

The connection module expediently has a single-part or preferably two-part module housing. In the case of a single-part embodiment of the module housing, said module housing can be embodied practically as an, in particular closed, frame having just one closed side face (end side) or side faces that are open on both sides, wherein, when the connection module is inserted into the circuit breaker housing, the respective chamber wall of the holding chambers of the circuit breaker housing covers the open side faces (end sides) of the module housing.

The connection contact is arranged in the module housing in a finger-safe manner. The contact element is expediently an angled contact piece having a contact limb inside the module, which contact limb is rail-guided in the holding chamber during insertion of the connection module into the circuit breaker housing and is thus practically automatically plug-connected to the coupling contact provided in the circuit breaker housing in order to establish the electrical connection with the desired component of the switching device.

The coupling contact inside the housing is expediently accessible via a housing slot, which is provided on the connection side and preferably extends over the entire housing width. As a result thereof, a plurality of series-arranged switch or circuit breaker modules, which have the circuit breaker housing, can be jointly brought into contact by means of a busbar and can be connected, for example, to the current-carrying feed line (or the positive pole or LINE) of a voltage or current supply. The corresponding connection side of the circuit breaker housing then virtually forms the voltage or supply input side of the switch or circuit breaker modules, while then the respective other connection side having the local connection module serves to connect a load and thus constitutes the load side of the circuit breaker housing.

The holding chamber for the connection module is expediently accessible from the front side of the circuit breaker housing. The connection module is thus expediently plugged into the circuit breaker housing from the front side thereof. However, it is also conceivable for the connection module to be able to be plugged into the circuit breaker housing from the connection sides thereof.

In one advantageous refinement, the circuit breaker housing and the connection modules are provided in the manner of a construction kit so that the preferably two-part circuit breaker housing with the desired switching device can be assembled with the electronic, thermal, thermomagnetic, thermohydraulic or (electro)magnetic components thereof and, where necessary, with a switching lock and with a switching or tilting lever before a single one or two of the provided connection modules having the desired connection contact in each case is inserted into the assembled circuit breaker housing. In this case, connection modules with different contact types can be provided. A first connection module or a second connection module or the connection contact thereof is therefore preferably embodied as a screw terminal or the first connection module or the second connection module or the connection contact thereof is designed as a screwless terminal, for example as a spring terminal. As a result, two connection modules having the same or different contact types can be associated with a circuit breaker module or the circuit breaker housing thereof. Connection modules whose connection contacts are embodied as a plug connection, as bolts with nuts (for comparatively high currents or current intensities) or the like can also be provided. In addition, in the case of a plurality of circuit breaker modules that are mounted, for example, as rail-mounted devices jointly on a DIN or carrier rail, connection modules provided in turn having different contact types are inserted (plugged) into the circuit breaker housing.

In an expedient refinement, the connection module has a module housing having a connection opening for a connection line, said connection opening leading to the connection contact. The connection opening is expediently located on that side of the module housing that, in the state of the connection module when it is incorporated into the circuit breaker housing, is flush with the front side or forms same together with the joined housing parts of the circuit breaker housing. This variant is particularly suitable in the case of a connection module having a screwless connection contact.

In the case of a connection module having a connection contact embodied as a screw terminal, the connection opening is expediently located at that side of the module housing that, in the state of the connection module when it is incorporated into the circuit breaker housing, is flush with the connection side or forms same together with the joined housing parts of the circuit breaker housing. The circuit breaker housing then expediently has on said connection side a housing slot for holding a busbar.

The module housing of the connection module also expediently has a tool opening for actuating the connection contact. The tool opening can be provided on the front-side or connection-side housing side of the module housing. Furthermore, the module housing expediently has a contact, plug or coupling opening. This is located at that housing side of the module housing that, when the connection module is inserted into the circuit breaker housing, faces toward the chamber base of the holding chambers of the circuit breaker housing and expediently abuts there.

Exemplary embodiments of the invention will be explained in more detail below with reference to the drawing figures:

Figure 1:
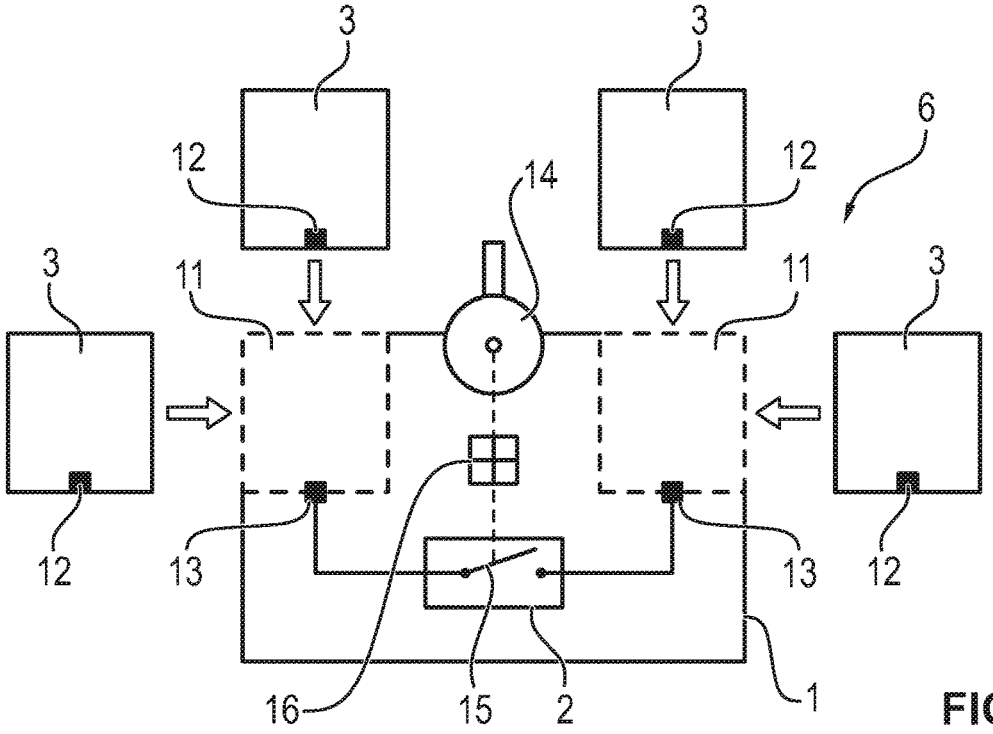
FIG. 1 schematically shows a circuit breaker housing having a switching device arranged therein for interrupting a circuit and having two holding chambers for provided connection modules for plug mounting into the holding chambers.

Parts that correspond to one another are provided with the same reference signs in all of the figures.

DESCRIPTION OF THE INVENTION

The exemplary embodiments described in the following figures relate to a circuit breaker housing 1 for providing a circuit breaker, switching device or circuit breaker module that is designed in modular fashion in the manner of a construction kit, which circuit breaker, switching device or circuit breaker module can be realized by the combination of different switching devices 2 and connection modules 3 having different connection contacts 4, 5 in a single-pole or multipole design. The core component of said construction kit system is the circuit breaker housing 1 that is suitable and configured for a fully functional single-pole circuit breaker module 6, which circuit breaker housing can also be fitted or equipped with the desired connection technology even after the completion and fitting thereof with the desired switching device 2 as an electrical or electronic, thermal, (electro) magnetic and/or hydraulic switching and/or tripping system and also even after or during DIN rail or switchgear cabinet mounting.

Figure 5:
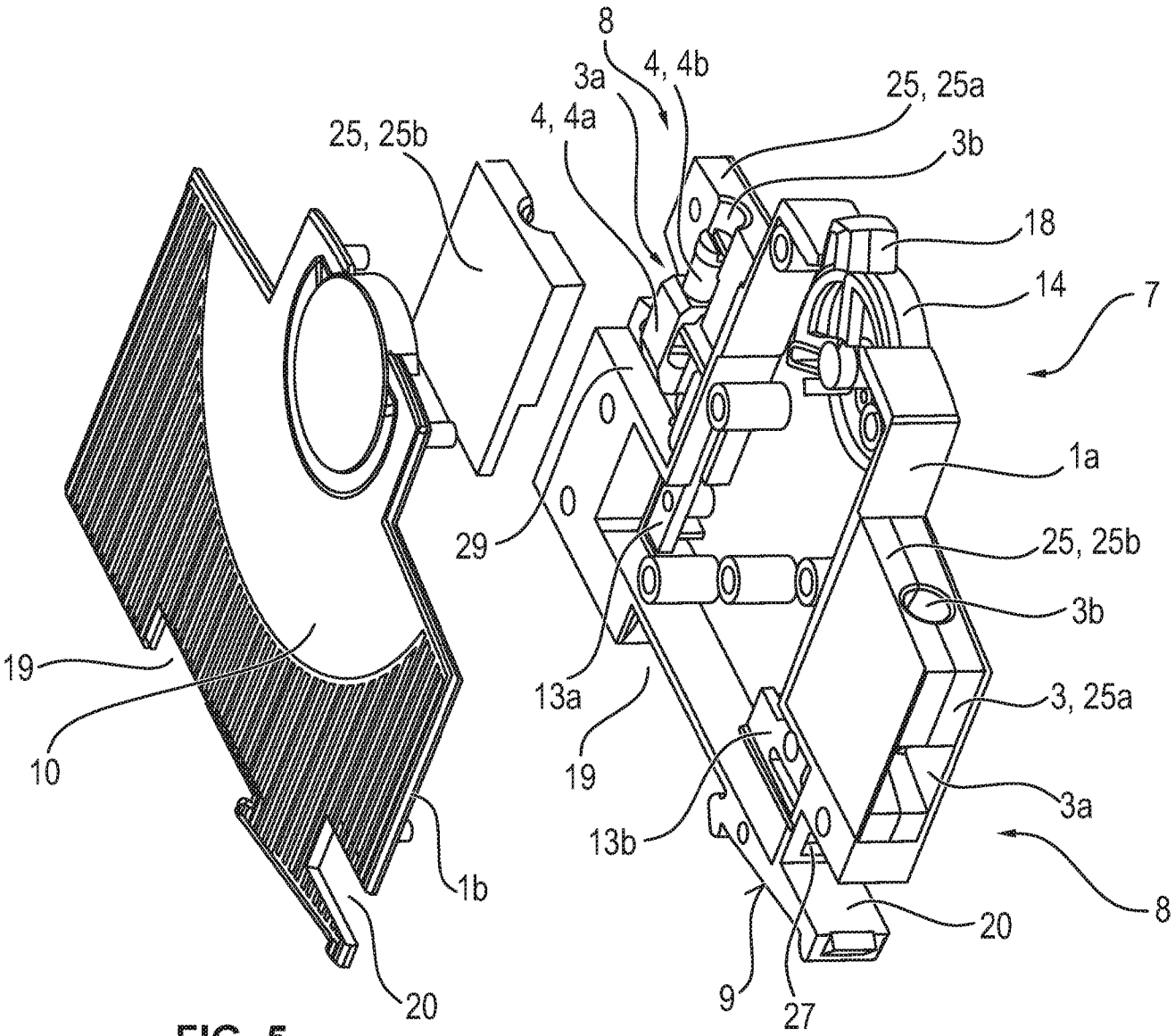
FIG. 5 shows a perspective exploded illustration of a first half-shell-shaped and a second top-like housing part of the circuit breaker housing having connection modules having two-part module housings inserted into one of the housing parts, of which module housings one is shown with non-joined module housing parts.
Figure 8:
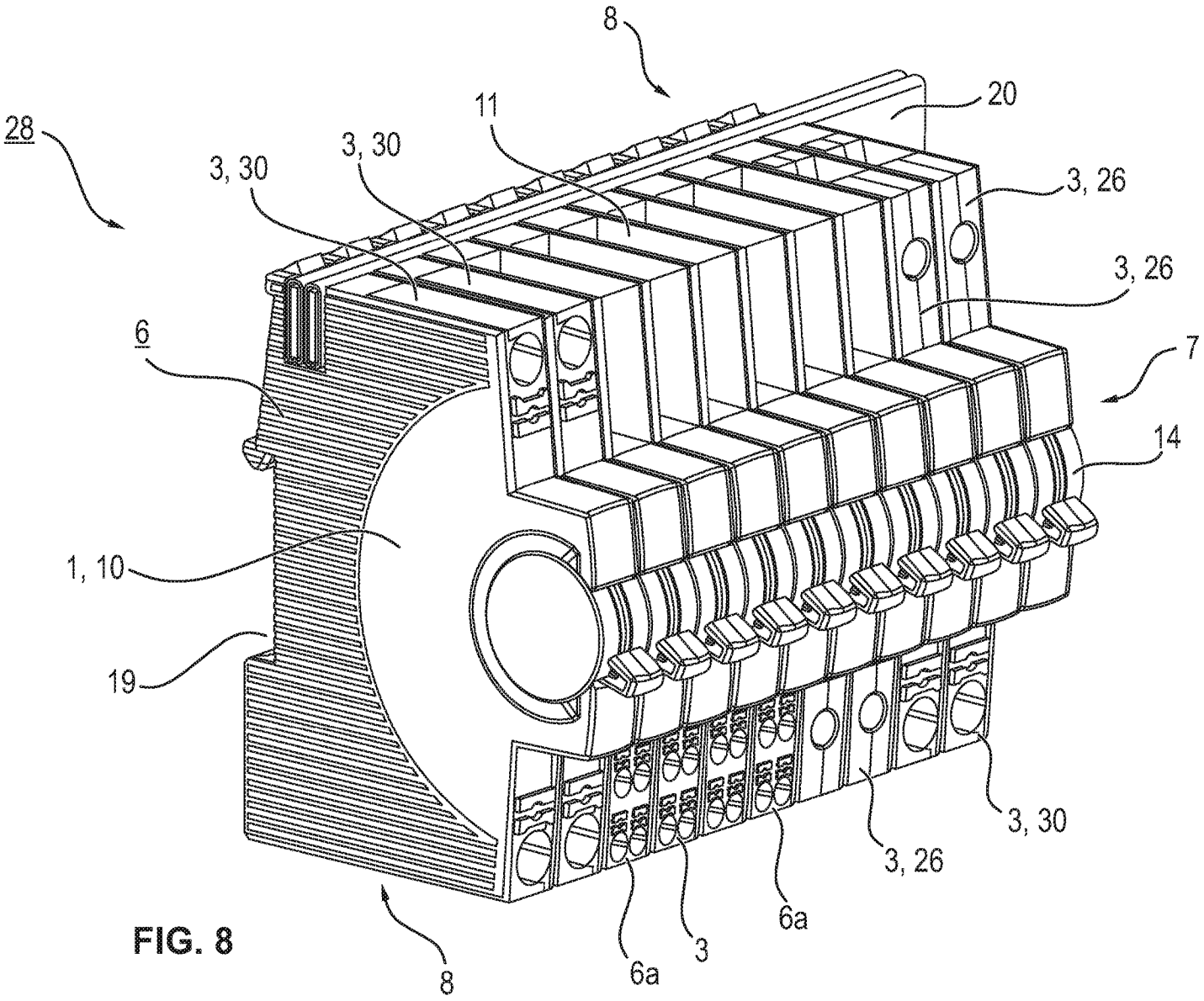
FIG. 8 shows a perspective view of a series arrangement having a plurality of circuit breaker modules having non-fitted and fitted holding chambers of the circuit breaker housing having connection modules, which have screwless spring terminal contacts or screw contacts as the connection contacts, wherein the supply-side connection contacts are connected to the busbar.

A single-pole circuit breaker, the circuit breaker housing 1 of which is shown by way of example in FIG. 5 in an exploded illustration, is accordingly formed substantially by a single circuit breaker module 6. Multipole designs of the circuit breaker, as are illustrated in FIG. 8, are formed by series arrangement of a number of circuit breaker modules 6, which number corresponds to the number of poles of the circuit breaker.

Figure 2:
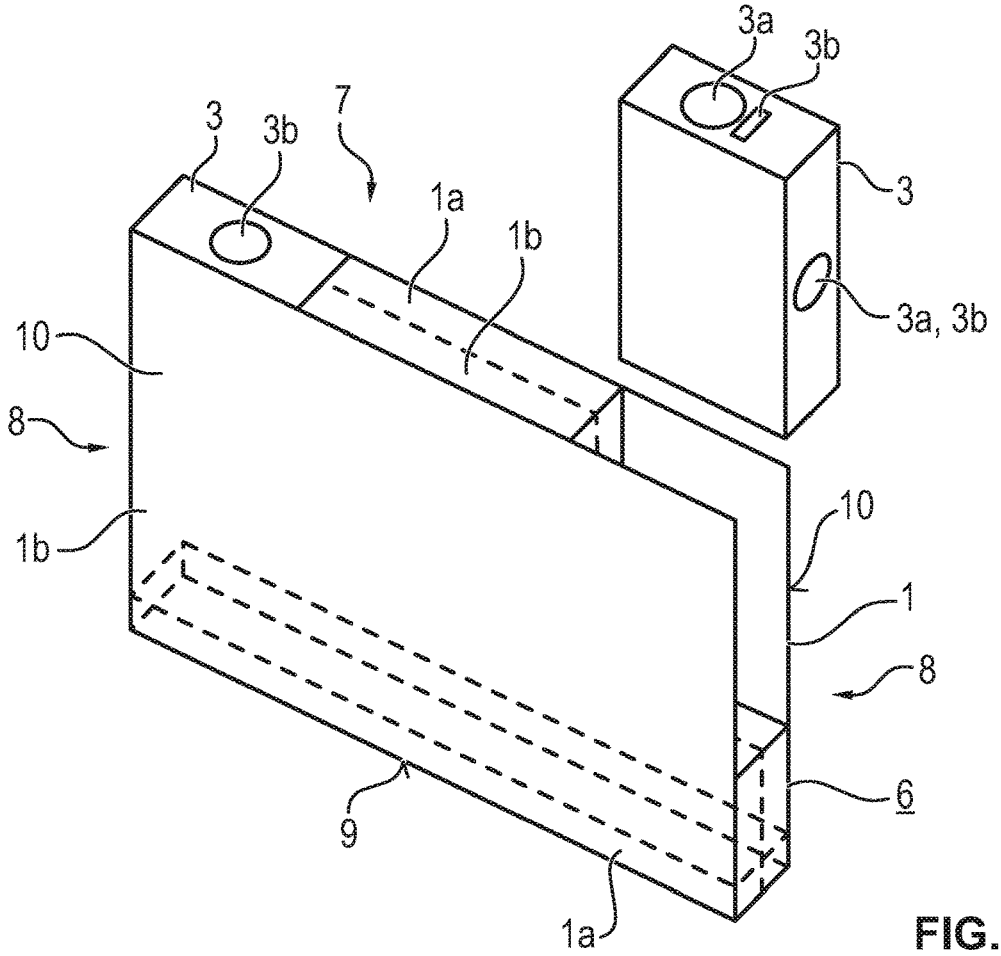
FIG. 2 shows a perspective illustration of the circuit breaker housing composed of two housing parts and having an inserted connection module and a further connection module in a pre-mounting position.

According to FIGS. 1 and 2, the circuit breaker module 6, which is shown in a transparent illustration and in a perspective view, respectively, comprises the circuit breaker housing 1 composed of insulating material. The circuit breaker housing 1 has two housing parts 1*a* and 1*b*, which can be joined to one another in releasable and nonreleasable fashion after fitting or mounting the switching device 2. As illustrated in FIG. 2, the housing parts 1*a* and 1*b* can each be embodied as housing half-shells. The first housing part 1*a* can also be embodied as a housing base and the second housing part 1*b* can also be embodied as a housing top. This is illustrated in FIG. 2 by the contours in dashed lines. According to the exemplary embodiment in FIG. 5, the first housing part 1*a* is preferably embodied as a housing half-shell and the second housing part 1*b* is preferably embodied as a housing top.

In the assembled or joined state of the housing parts 1*a* and 1*b*, these and hence the circuit breaker housing 1 form a front side 7 and two connection sides 8 adjoining said front side and also a rear side 9 located opposite the front side 7 and two end or side faces 10 located opposite one another. The front side 7 and the rear side 9 form, together with the opposite connection sides 8, in circumferential fashion the narrow housing sides of the circuit breaker housing 1 whereas the comparatively extensive end faces or sides 10 located opposite one another form, in particular, the rail-mounted sides of the circuit breaker housing 1.

To hold the connection modules 3 in the circuit breaker housing 1, said circuit breaker housing has holding pockets or holding chambers 11, which are expediently open on the front side 7 and on the respective connection side 8. As illustrated in FIG. 1, the respective connection module 3 can preferably be inserted (plugged) into the corresponding holding chamber 11 from the front side 7 but also conceivably from the respective connection side 8. The corresponding plugging direction is illustrated by the arrows shown. The connection modules 3 have a contact element 12, which is brought into plug contact with a preferably premounted coupling contact 13 arranged in the circuit breaker housing 1 over the course of the plug mounting.

The switching device 2 of the circuit breaker module 6, which can have hand actuation mechanics having a pivoting or tilting lever 14, can comprise a short-circuit tripping device, which is designed to actuate the tripping device (tripping mechanics) in the case of a short circuit as tripping condition. The short-circuit tripping device can be embodied in electronic fashion, for example with a semiconductor switch in the form, in particular, of a (bipolar) power transistor (MOSFET). The short-circuit tripping device can also have a magnet coil, magnet yoke and a magnet armature, which is connected to a plunger provided for advancing a tripping slide. In addition or as an alternative, the tripping system of the switching device 2 can have a, for example thermal, overload tripping device, which is expediently formed substantially by a bimetallic strip, which heats up as a result of the flow of current through the circuit breaker and in the process deforms in such a way that it actuates the tripping device or the substantially mechanical or thermomechanical tripping system in the case of overload.

The switching device 2 and the tripping system thereof illustrated symbolically in FIG. 1 has a switch 15, which is embodied as a power transistor (semiconductor) or in mechanical fashion having a moving and a stationary contact. In particular, in the case of the mechanical embodiment of the switch 15, said switch is coupled to the tilting lever 14 by means of a switching lock 16. In the case of an electronic embodiment, the switching device 2 typically comprises a control device in the form of a microprocessor (microcontroller), which blocks the electronic switch 15 and thus interrupts a circuit, in which the circuit breaker module 6 is incorporated, when a measured current and/or voltage measurement value exceeds a prescribed tripping threshold. In the case of a mechanical embodiment, the tripping, that is to say opening of the contacts, is effected, for example, in a thermal or thermomagnetic manner.

Figure 3:
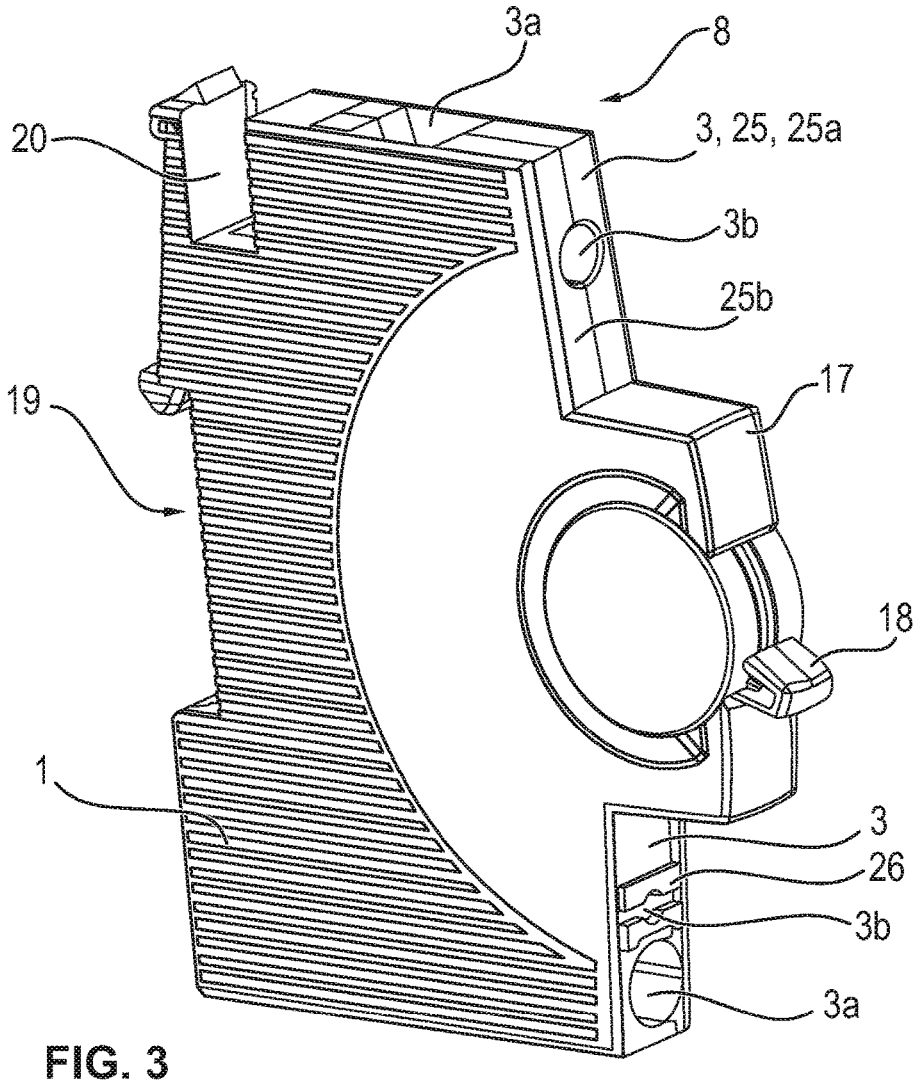
FIG. 3 shows a circuit breaker module embodied as a rail-mounted device for DIN rail mounting and having a circuit breaker housing having connection modules that are accessible from the front side, of which connection modules one has a screwless connection contact and the other has a connection contact embodied as a screw contact.

FIG. 3 shows a circuit breaker housing 1, which is suitable for a rail-mounted device, having inserted connection modules 3. The circuit breaker housing 1 accordingly has the stepped shaping symmetrical to the front side 7 that is characteristic of such devices. At a projecting central part 17 of the front side 7, a handle 18 of a tilting or pivoting lever 14 projects out of the circuit breaker housing 1 for the purpose of actuating the circuit breaker module 6. On the rear side 9 located opposite the front side 7, the circuit breaker housing 1 is provided with a receptacle or recess 19, which is typical for rail-mounted devices, for snapping the circuit breaker module 6 onto a carrier rail, in particular a DIN rail.

Figure 4:
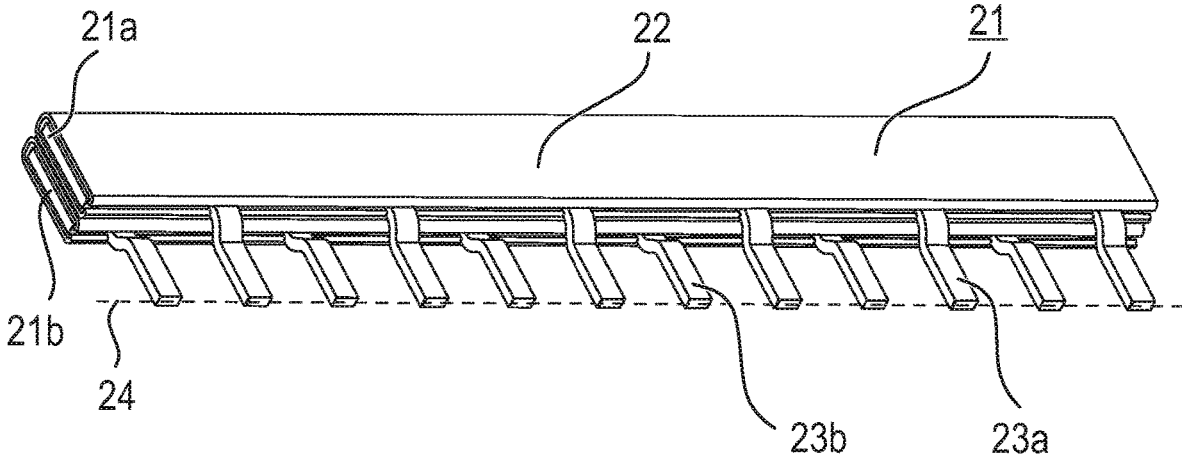
FIG. 4 shows a perspective view of a busbar for making plug contact with one of the connection modules, in this case having the connection contact embodied as a screw contact according to FIG. 3.

On the connection side 8, at the top in FIG. 3, the circuit breaker housing 1 has a continuous housing slot 20 for holding a busbar 21, which is illustrated in FIG. 4. The busbar 21 provided with an insulating cover 22 is double-layered, wherein the bar layers 21*a* and 21*b* are insulated from one another. Each of the bar layers 21*a* and 21*b* has a number of plug contacts 23*a* and 23*b* spaced apart equidistantly from one another, which plug contacts are bent toward one another and are flush with one another in a plug line 24, which is indicated by a dashed line. The desired terminal contact-making with the respective connection module 3 is established using in each case one of said plug contacts 23*a* or 23*b* in order to electrically couple a plurality of connection modules 3 and hence a plurality of circuit breaker modules 6 to one another.

As can be seen in FIG. 3 on the top connection module 3, said connection module has a two-part module housing 25, the two module housing parts 25*a*, 25*b* of which are embodied in a half-shell shaped manner or in a half-shell shaped and top-like manner. On the front side, the module housing 25 of the top connection module has a tool opening 3*b* for a tool (for example for a screwdriver) whereas the module housing 25 of the connection module 3 at the bottom in FIG. 3 has on the front side a connection opening 3*a* for a connection line. Such a connection opening 3*a* is provided on the connection side in the case of the module housing 25 of the top connection module 3 whereas the tool opening 3*b* is likewise provided with an inserted plastic wedge 26 of the module housing 25 of the bottom connection module 3 on the front side and directly next to the connection opening 3*a*.

FIG. 5 shows the circuit breaker housing 1 in an exploded illustration having two similar connection modules 3 in the first half-shell-shaped housing part 1*a*. The connection modules 3 each have a screw contact as the contact element 4, the contact part 4*a* of which is accessible via the connection opening 3*a* of the connection module 3, and the contact screw 4*b* of which protrudes in a finger-safe manner into the tool opening 3*b* of the connection module 3. The connection contact 4 is brought into plug contact with the coupling contact 13 of a contact type 13*a*, which is arranged inside the housing in the first housing part 1*a* and thus in the circuit breaker housing 1. That connection module 3 that is inserted into the local holding chamber 11 of the circuit breaker housing 1 on that connection side 8 that also has the housing slot 20 is likewise brought into plug contact with the coupling contact 13 of a contact type 13*b* inside the housing. Said coupling contact 13 of the type 13*b* is accessible via a plug opening 27 provided in the slot base of the housing slot 20. One of the plug contacts 23*a* or 23*b* of the busbar 21 inserted into the housing slot 20 is brought into plug contact with the coupling contact 13 of the type 13*b* by means of said plug opening 27.

Figure 6A:
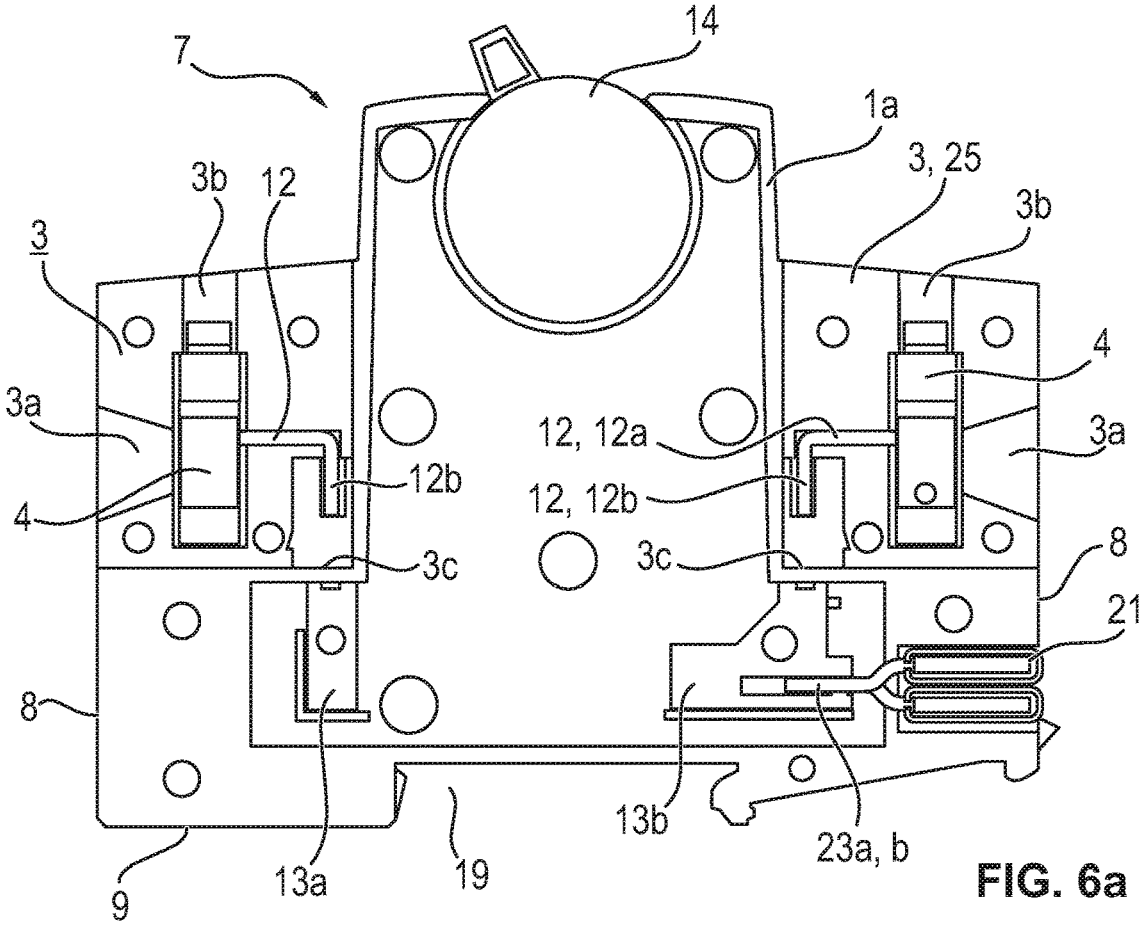
FIGS. 6A and 6B show the first housing part having inserted housing parts of the module housings of the connection modules in a screw connection embodiment and inserted coupling contacts, which are brought into plug contact with contact elements of the connection contacts of the connection modules, and having a busbar in plug contact with one of the coupling contacts or the second housing part of the circuit breaker housing.
Figure 6B:
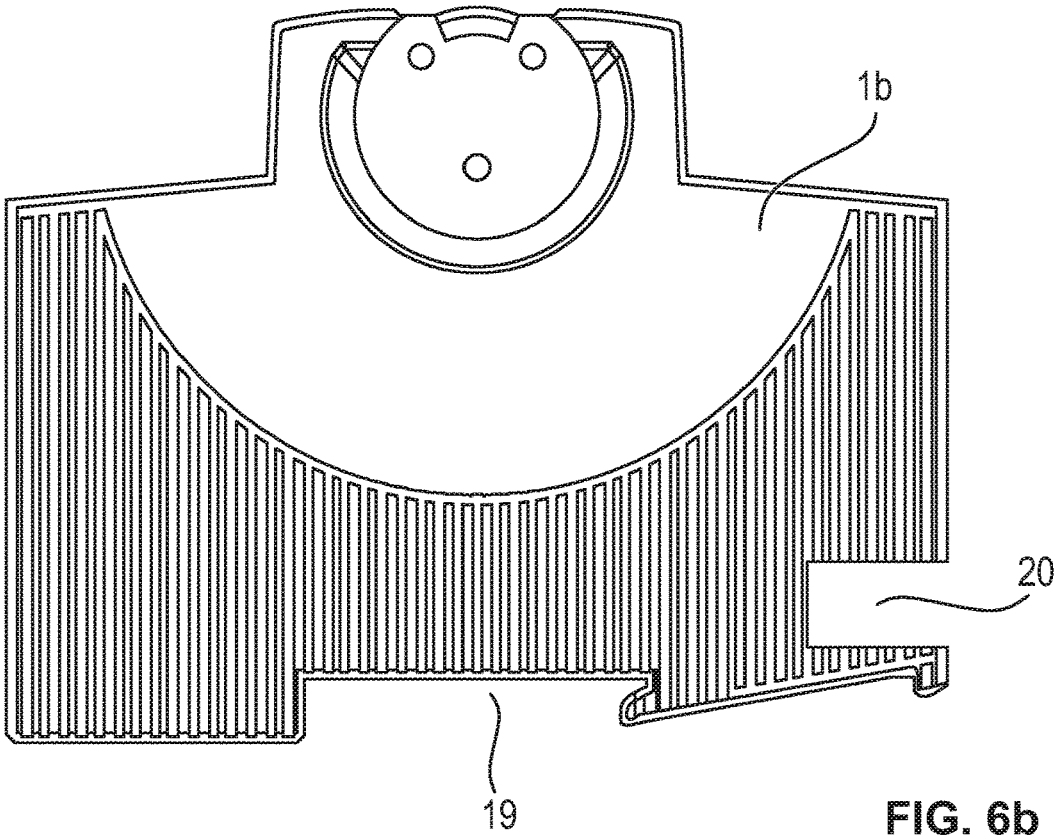

FIGS. 6*a* and 6*b* show the circuit breaker housing 1 having the first housing part 1*a* in FIG. 6*a* and the second housing part 1*b* in FIG. 6*b*. The plug contact-connection of the busbar 21 with the associated coupling contact 13 of the type 13*b* is shown in FIG. 6*a*. The coupling contact 13 is brought into plug contact with the connection contact 4 by means of the contact element 12, which is bent in an angled manner and is arranged inside the connection module 3 or the module housing 25 thereof. To this end, the coupling element 12 has a contact limb 12*a* in contact with the connection contact 4 and a coupling limb 12*b*, which is brought into plug contact with the coupling contact 13.

In the case of the connection module 3 inserted into the corresponding holding chamber 11 on the opposite connection side 8, the local coupling contact 13 of the type 13*a* is likewise brought into plug contact by means of the angularly bent contact element 12. Said coupling contact 13 of the type 13*a* is not designed for busbar contact-connection.

Figure 7A:
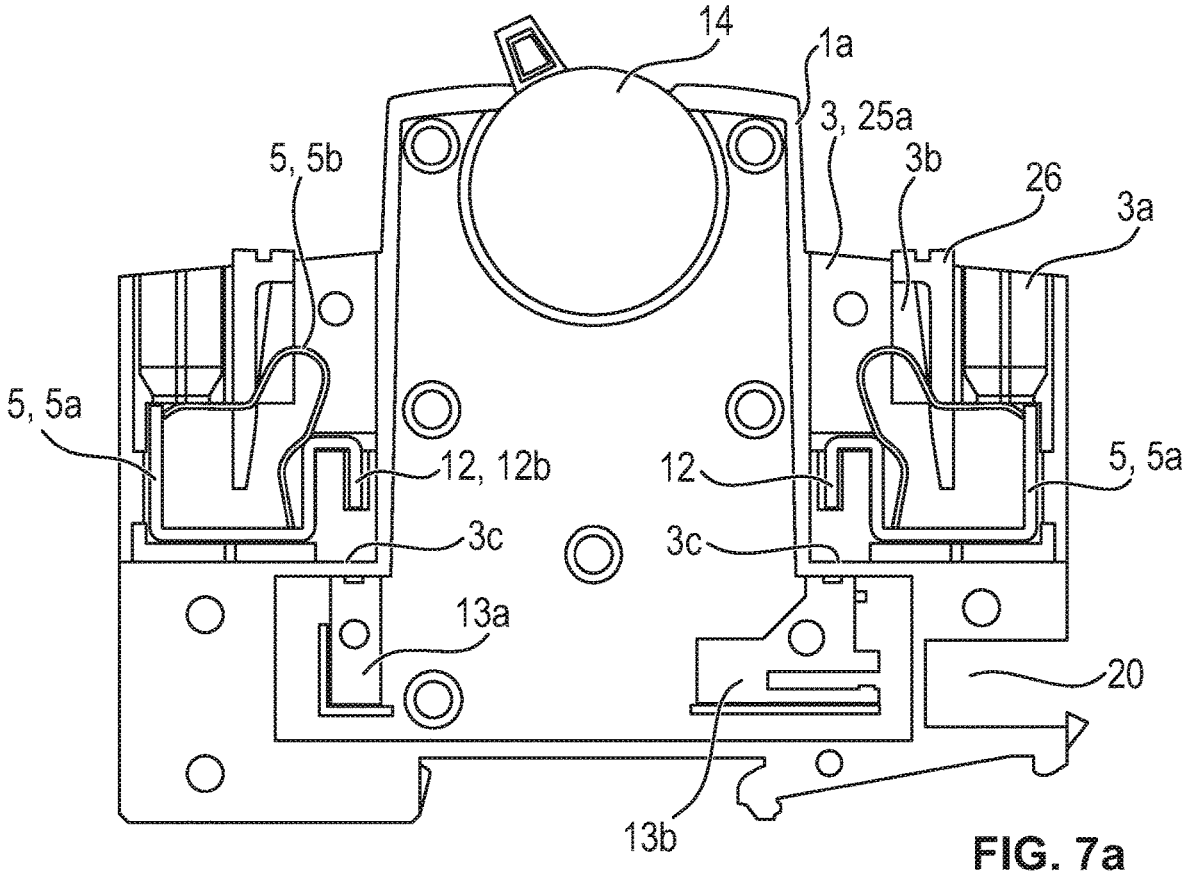
FIGS. 7A and 7B show an illustration according to FIGS. 6*a* and 6*b* of the first housing part having inserted connection modules in a spring terminal embodiment or the second housing part of the circuit breaker housing.
Figure 7B:
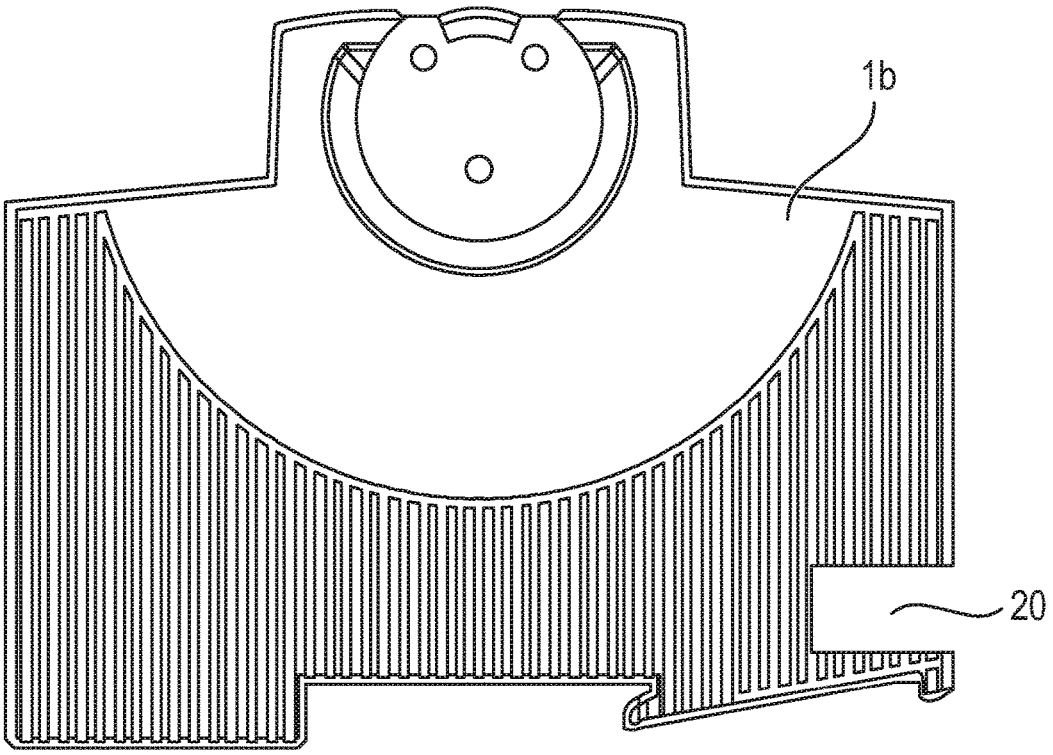

FIGS. 7*a* and 7*b* show in an analogous manner to FIGS. 6*a* and 6*b* the circuit breaker housing 1 having the first housing part 1*a* thereof in FIG. 7*a* and the second housing part 1*b* thereof in FIG. 7*b*. In contrast to the exemplary embodiment according to FIGS. 6*a* and 6*b*, a connection module 3 having a screwless connection contact 5 embodied as a spring terminal is inserted into housing part 1*a* shown in FIG. 7*a* on both connection sides 8. Said connection contact comprises a contact part 5*a* bent in an approximately S-shaped manner and a spring element 5*b* bent in an approximately V-shaped manner. The plastic wedge 26, which is inserted into the tool opening 3*b* of the connection module 3, serves to actuate the spring element 5*b* in order to release a connection cable inserted into said spring element by means of the connection opening 3*a* of the connection module 3 from a produced terminal contact-connection. Said screwless connection module 3 having the coupling contact 13*b* provided for the contact-connection with the busbar 21 is brought into connection contact again by means of the contact element 12, 12*b*, which is formed by a limb of the S-shaped contact part 5*a*.

As in the case of the embodiment according to FIGS. 6*a* and 6*b* as well, in this embodiment according to FIGS. 7*a* and 7*b*, the respective coupling contact 13 can be inserted into the connection module 3 or the module housing 25 thereof by means of the plug or coupling opening 3*c* in order to be held thereby in the course of insertion of the connection module 3 into the holding chamber 11 of the circuit breaker housing 1 and to be brought into plug contact with the contact element 12.

FIG. 8 shows a circuit breaker or a circuit breaker arrangement 28 having a number of single-pole or multipole circuit breaker modules 6, which can be mounted in the manner of rail-mounted devices on a DIN rail (not illustrated). The circuit breaker modules 6 have identical circuit breaker housings 1 and similar connection modules 3, the module housings 25 of which are fitted with identical or different connection contacts 4, 5.

The circuit breaker modules 6 of the circuit breaker arrangement 28 have connection modules 3 having different connection contacts 4, 5. The or some of the circuit breaker modules 6 are electrically connected to one another on the supply side by means of the busbar 21 and in this case connected in parallel in the supply side. On the opposite load side, the circuit breaker housings 1 of the circuit breaker modules 6 are provided with identical or different connection modules 3 or connection contacts 4, 5. Four of the connection modules 3, which are denoted in FIG. 8 by 6*a*, are embodied in a multipole manner whereas the remaining connection modules 3 or circuit breaker modules 6 are single-pole. In addition, two or more connection lines to accordingly two or more loads can also be connected to a circuit breaker module 6 or to the load-side connection module 3 thereof.

In summary, the circuit breaker housing 1 provided and configured to hold the switch unit 2 and a number of connection modules 3 with the connection contacts 4, 5 thereof has two housing parts 1*a* and 1*b*, wherein, in the joined or assembled state, the housing parts 1*a* and 1*b* form the front side 7 and the rear side 9 located opposite said front side and the connection sides 8 and end faces 10 located opposite one another, and wherein a holding chamber 11 for the connection module 3 having the respective connection contact 4 or 5 is provided on the front side 7 and/or on at least one of the connection sides 8. The first and/or the second housing part 1*a*, 1*b* and thus the circuit breaker housing 1 is configured to hold a mechanical, electrical or electronic, thermal, magnetic and/or hydraulic switching device 2.

The connection module 3 has a module housing 25, which has the connection opening 3*a* for a connection line, said connection opening leading to the connection contact 4, and the contact, plug or coupling opening 3*c*, wherein the connection opening 3*a* is arranged at that housing side of the module housing 25 that faces toward the front side 7 or the connection side 8, is flush therewith or forms same when the connection module 3 is inserted into the holding chamber 11, and wherein the contact opening 3*c* is arranged at that housing side of the module housing 25 that faces toward a chamber base 29 (FIG. 5) of the holding chamber 11 when the connection module 3 is inserted into the holding chamber 11.

The module housing 25 also has the tool opening 3*b* for actuating the connection contact 4, 5, wherein the tool opening 3*b* is arranged at that housing side of the module housing 25 that faces toward the front side 7 or the connection side 8, is flush therewith or forms same when the connection module 3 is inserted into the holding chamber 11.

The invention is not restricted to the exemplary embodiments described above. Instead, other variants of the invention can also be derived herefrom by the person skilled in the art without departing from the subject matter of the invention. In particular, all of the individual features described in connection with the exemplary embodiments can furthermore also be combined with one another in a different way without departing from the subject matter of the invention.

LIST OF REFERENCE SIGNS

1 Circuit breaker housing
1*a* First housing part
1*b* Second housing part
2 Switching device
3 Connection module
3*a* Connection opening
3*b* Tool opening
3*c* Coupling/plug/contact opening
4 Connection/screw contact
4*a* Contact part
4*b* Contact screw
5 Connection/spring terminal
5*a* Contact part
5*b* Spring element
6 Circuit breaker module
7 Front side
8 Connection side
9 Rear side
10 End/side face
11 Holding chamber
12 Contact element
12*a* Contact limb
12*b* Coupling limb
13 Coupling contact
14 Pivoting/tilting lever
15 Switch
16 Switching lock
17 Central part
18 Handle
19 Receptacle/recess
20 Housing slot
21 Busbar
21*a, b* Bar layer
22 Insulating cover
23*a, b* Plug contact
24 Plug line
25 Module housing
25*a, b* Housing part
26 Plastic wedge
27 Plug opening
28 Circuit breaker/circuit breaker arrangement
29 Chamber base

The invention claimed is:

1. A circuit breaker housing for holding a switching device and a number of connection contacts for a connection line and/or a busbar, the circuit breaker housing comprising:

a first housing part and a second housing part;

at least a first and second connection module having a connection contact for a connection line;

wherein, in a joined or assembled state, said first and second housing parts together form a front side and a rear side opposite said front side, and at least one connection side and end faces located opposite one another; and wherein a holding chamber for receiving at least one connection module having one of said connection contacts is formed on said front side and/or on at least one of said connection sides; and wherein each connection module has a module housing, which has a connection opening for a connection line, said connection opening leading to the connection contact, and a contact opening;

wherein the connection opening is arranged at that housing side of the module housing that faces toward the front side or the connection side, is flush therewith or forms same when the connection module is inserted into the holding chamber, and wherein the contact opening is arranged at that housing side of the module housing that faces toward a chamber base of the holding chamber when the connection module is inserted into the holding chamber;

wherein the first connection module and/or the second connection module has a screw terminal or a screwless spring terminal as connection contact; and wherein the connection contact of the first or the second connection module has a contact element for electrical connection with a coupling contact received by the housing parts in the joined or assembled state, the coupling contact being accessible via a housing slot provided on the connection side.

2. The circuit breaker housing according to claim 1, wherein said housing slot extends over an entire housing width.

3. The circuit breaker housing according to claim 1, wherein said holding chamber for said connection module is accessible from said front side and/or from the respective said connection sides.

4. The circuit breaker housing according to claim 1, wherein said module housing is formed with a tool opening for actuating said connection contact, wherein said tool opening is arranged at that housing side of said module housing that faces toward said front side or said connection side, is flush therewith or forms same when said connection module is inserted into said holding chamber.

5. The circuit breaker housing according to claim 1, wherein at least one of said first housing part or said second housing part is configured to hold a switch unit selected from the group consisting of mechanical, electrical or electronic, thermal, magnetic, and hydraulic switching devices.

6. The circuit breaker housing according to claim 1, wherein at least one of said first housing part or said second housing part is configured to hold a switching device with a semiconductor switch or a contact system having a moving contact and a stationary contact.

7. A circuit breaker module, comprising a circuit breaker housing according to claim 1, a switching device, and at least one connection module with a connection contact.

8. A circuit breaker, comprising: a plurality of single-pole or multipole circuit breaker modules, each of said circuit breaker modules including a circuit breaker housing according to claim 1, a switching device in said housing, and at least one connection module with a connection contact.

9. The circuit breaker according to claim 8, comprising a busbar configured to make plug contact with the coupling contact of the respective said connection module in order to jointly electrically conductively connect a plurality of connection modules and/or circuit breaker modules.

* * * * *